US007063092B2

(12) United States Patent
Cerruti

(10) Patent No.: US 7,063,092 B2
(45) Date of Patent: Jun. 20, 2006

(54) WASHING AGENT DISPENSING DEVICE FOR A HOUSEHOLD WASHING MACHINE, IN PARTICULAR A DISHWASHER

(75) Inventor: Daniele Cerruti, Fontanetto (IT)

(73) Assignee: Eltek, S.p.A., Casale Monferrato (IT)

( * ) Notice: Subject to any disclaimer, the term of this patent is extended or adjusted under 35 U.S.C. 154(b) by 289 days.

(21) Appl. No.: 10/239,488

(22) PCT Filed: Mar. 26, 2001

(86) PCT No.: PCT/IB01/00481

§ 371 (c)(1),
(2), (4) Date: Nov. 4, 2002

(87) PCT Pub. No.: WO01/72198

PCT Pub. Date: Oct. 4, 2001

(65) Prior Publication Data

US 2003/0106570 A1 Jun. 12, 2003

(30) Foreign Application Priority Data

Mar. 29, 2000 (IT) ..... TO2000A0300

(51) Int. Cl.
*A47L 15/46* (2006.01)

(52) U.S. Cl. ..... 134/93; 66/17 R; 222/652

(58) Field of Classification Search ..... 134/93, 134/94.1, 99.2; 68/17 R; 222/651, 652, 222/165, 166, 167
See application file for complete search history.

(56) References Cited

U.S. PATENT DOCUMENTS 3,212,675 A * 10/1965 Krzewina ..... 222/652
3,876,117 A * 4/1975 Wright et al. ..... 222/651
3,915,349 A * 10/1975 Losert et al. ..... 222/166
4,009,801 A * 3/1977 Williams ..... 222/651
4,149,656 A * 4/1979 Nelson ..... 222/652
4,265,100 A * 5/1981 Kretchman et al. ..... 68/12.18
5,310,090 A * 5/1994 Taylor, Jr. ..... 222/129

FOREIGN PATENT DOCUMENTS

DE 19843976 A1 * 4/1999

* cited by examiner

*Primary Examiner*—Joseph L. Perrin
(74) *Attorney, Agent, or Firm*—Levine & Mandelbaum

(57) ABSTRACT

A device is described, for dispensing washing agents for a household washing machine, in particular a dishwasher, said dispenser (1) having at least a space (3B) for containing an amount of washing agent necessary for performing a washing cycle, wherein the charging of said amount of washing agent in said space (3B) is performed manually and the dispensing of the washing agent is performed at least partially by gravity. According to the invention, the device comprises at least a dispensing body (3) capable of performing angular or rotary movements around a first axis and angular movements with respect to a second axis.

53 Claims, 8 Drawing Sheets

FIG. 5
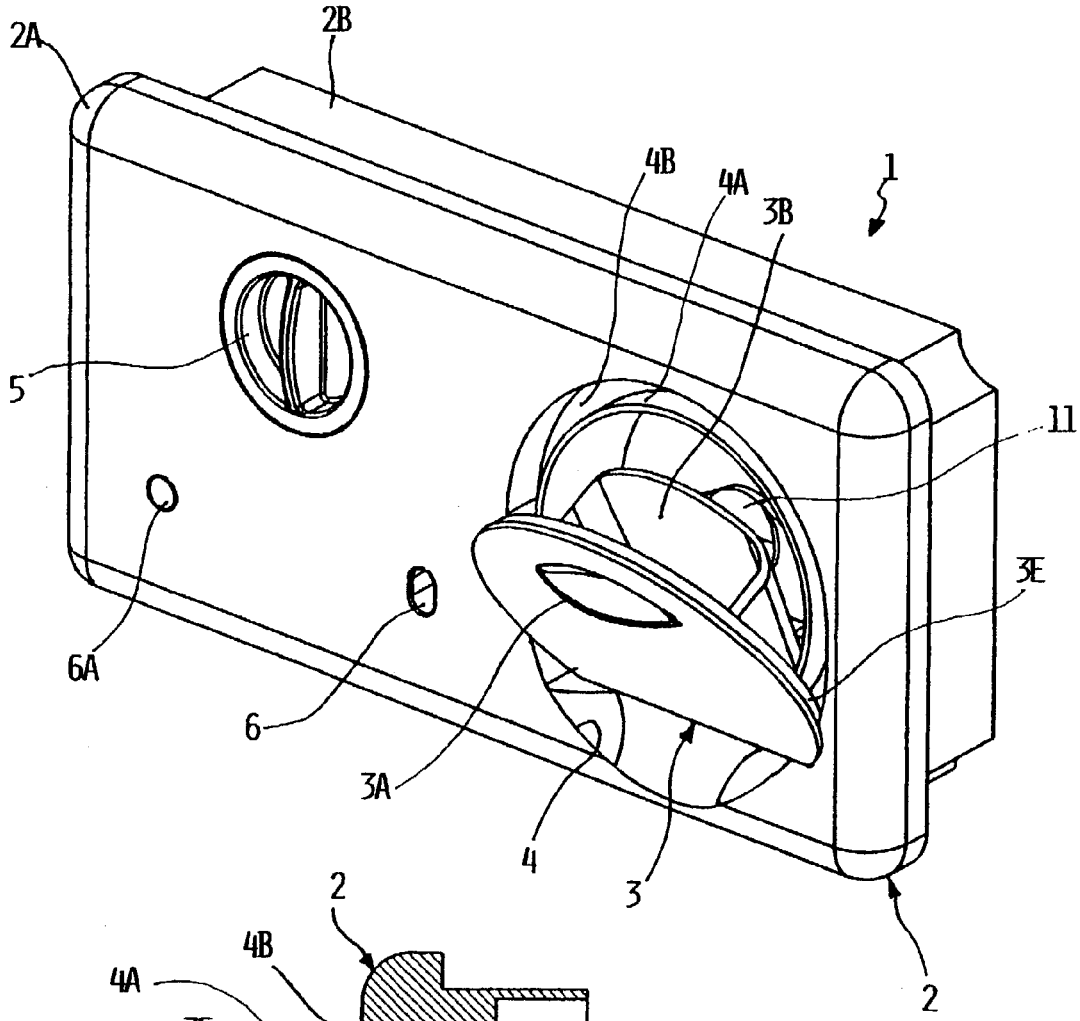
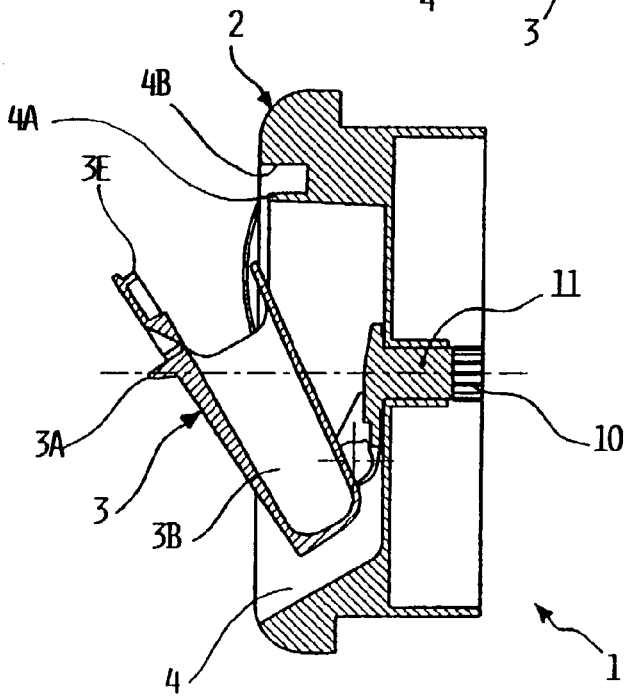
FIG. 6

WASHING AGENT DISPENSING DEVICE FOR A HOUSEHOLD WASHING MACHINE, IN PARTICULAR A DISHWASHER

DESCRIPTION

The present invention relates to a device for dispensing washing agents for a household washing machine, in particular a dishwasher, as described in the preamble of the annexed claim 1.

As known, washing machines are usually equipped with a device for dispensing washing agents, namely washing detergents and additives in powder and/or liquid form; typically, the latter typically consisting of softening media for laundry washing machines and rinsing aids for dishwashing machines.

In the instance of a dishwasher, the dispenser of washing agents usually comprises a body made from plastic material, partially built-in on one of the vertical surfaces delimiting the washing tub of the machine; in most cases, this vertical wall is the dishwasher inner door, i.e. the side of the machine front loading door facing inside the wash tub.

In its front zone, the above body define a space, with a small tilting or sliding cover, for containing a given amount of detergent, usually in powder or in the form of a tablet, being necessary for performing a washing cycle.

Inside the dispenser body a tank is also provided, for containing a second liquid washing agent, typically a rinsing aid; in general, this tank has a capacity such to contain an amount of liquid agent being sufficient for several washing cycles, so that the machine user has only to fill periodically the tank through a proper plug.

Within the dispenser a small chamber is associated to the above tank, which is used for dosing the amount of rinsing aid to be delivered during a washing cycle; to this purpose the dosing system of the rinsing aid exploits the opening-closing movement of the machine door, i.e. horizontal when open and vertical when closed, to supply some rinsing aid from the tank to the dosing chamber; during the machine operation, a programmer or timer operates an actuator to free a discharge outlet in correspondence with the dosing chamber and let the dosed amount of rinsing aid flow from the latter into the washing tub of the dishwasher.

As said, the known technique mentioned above requires the dispenser to be fixed to the dishwasher door, exploiting its opening-closing movement for the dosage of the rinsing aid required for a washing cycle; for this reason, application of the above dispensers is restricted to washing machines fitted with a door tilting around a horizontal axis.

For the above reasons, the dispenser is designed to have the opening of the space for containing the detergent facing upwards when the machine door is open; therefore, after the door has been brought in horizontal position, the user can fill the space with the detergent, close its cover and then bring the door back to its closed position again; the cover of the space for containing the detergent is usually a tilting or sliding cover; its opening at an appropriate time during the washing cycle to let the detergent fall down by gravity in the washing tub is controlled by a machine programmer or timer.

The above prior art also imply the detergent to be filled in its relevant space with the machine door being open, i.e. a position somewhat uncomfortable for the user, particularly considering that, contrary to the filling of the rinsing aid, such a detergent, either in the form of powder or tablet, has to be charged in the relevant space before starting each washing cycle.

Some known washing machines have no tilting door, but the latter is linearly sliding on appropriate guides; with reference to a double-basket dishwashing machine, reference can be made to the solution described in FR-A-2.674.426; other known dishwashers, vice-versa, have only one basket for containing the crockery to be washed, which is designed like a sliding drawer, whose front wall realizes in fact the machine door.

Also in these machines the dispenser of the washing agents is fixed to the machine door or anyway to a wall or vertical surface delimiting the washing tub; as a result, the dispenser is always on the same resting plane, independently from the door opening-closing condition. Therefore, the dispensers used on such machines have to be equipped with a proper electric pump, capable of dosing and dispensing the liquid washing agent. As regards powder or solid detergents, these dispensers have a seat for housing a container, the latter being open upwards, partly tiltable and hinged on its lower end.

The cited container can be partially extracted from its seat and inclined outside the dispenser body, for filling it with the detergent dose; a reverse movement of the container puts it back in position in the housing seat defined in the dispenser body.

This solution is complex and expensive, since it requires the presence of a suitable hydraulic circuit for conveying water inside the above detergent container to draw the detergent out and flow it into the machine washing tub; this solution is further complex, expensive and critical, since such an hydraulic circuit has to be partially housed within the machine door.

Finally, other dispensing devices are also known for powder detergents, having a long autonomy, which are mounted on the machine door are, which are equipped with a tank for containing a quantity of detergent being sufficient to perform a plurality of washing cycles, as well as of means for dosing and dispensing single predetermined doses of such a detergent.

Quite schematically, according to such solutions, the dosing and dispensing means comprise a substantially cylindrical body, which is angularly movable and bears one or more recesses, located under the outlet mouthpiece of the detergent tank.

In a first stage, a suitable actuator rotates the cylindrical body until one of its recesses is brought in correspondence with the above outlet mouthpiece; in this way, some of the detergent contained in the tank fill this recess by gravity.

Subsequently, the cylindrical body is rotated by about 180°, taking the above recess in correspondence with a lower discharge outlet facing on the machine washing tub, wherein the detergent contained in the recess can fall down by gravity.

A solution of this type is described for example in IT-A-1.242.282.

According to this type of solutions, the filling of the detergent is more comfortable for the user, since this operation can be performed at intervals and with the machine door half-open; in addition, in certain solutions, the detergent tank can be removed, so making the filling extremely comfortable for the user (see for example the above cited IT-A-1.242.282).

However, also the long autonomy dispensers of the type mentioned above have several drawbacks.

A first drawback is due to a considerable manufacturing complexity of the device, which requires the use of many components and kinematic motions, as well as the presence of an actuator suitable to produce the rotation of the dosing and dispensing drum, being subject to many frictions of movement.

Another drawback derives from the overall dimensions of the device, which occupies a considerable space inside the washing tub; the likely insertion of the device inside the machine door would also be quite difficult and critical for maintenance purposes.

A further drawback is also represented by the need of a hygroscopic insulation of the inside the device against the outside environment, to avoid possible deterioration of the detergent contained in the tank due to humidity and water being present within the machine tub during washing; this implies the use of suitable sealing arrangements, in particular peripheral ones, which are subject to wear and which further complicate the device from its manufacturing and function standpoint, causing a further costs increase.

The present invention has the aim of solving the above drawbacks by means of a dispensing device of washing agents for a washing machine, apt to dispense a quantity of washing agent being necessary for the execution of a treatment cycle performed by the machine, which is of simple manufacturing, comfortable in use, reliable in operation and having a low cost.

Within this general frame, a first aim of the present invention is to provide a dispenser wherein the filling of the washing agent can be performed in a comfortable and easy position for the user, both when the device is fixed to a sliding door or constantly vertical surfaces and when the device is fixed on tilting doors.

A further aim of the present invention is to provide a dispenser which comprises a minimum number of movable parts, without requiring any complex arrangements for realizing the dispensing the washing agent.

A further aim of the present invention is to provide a dispenser of washing agents which employs simple and reliable actuating and sealing means.

A further aim of the present invention is to provide a dispenser which can be assembled indifferently on tilting doors or sliding doors or constantly vertical surfaces.

One or more of said aims are attained, according to the present invention, by a device for dispensing washing agents for a household washing machine, in particular a dishwasher, incorporating the features of the annexed claims, which form an integral part of the present description.

Further aims, features and advantages of the present invention will become apparent from the following detailed description and annexed drawings, which are supplied by way of non limiting example, wherein:

FIG. 5 show a perspective view of the front part of the dispenser of washing agents according to the present invention, in a second operating condition;

FIG. 6 shows a section, along the axis A—A of FIG. 3, of the dispenser of washing agents according to the present invention, in the operating condition of FIG. 5;

In the annexed figures, reference 1 indicates as a whole a dispenser of washing agents realized according to the teachings of the present invention, to be used in a washing machine; in the herein given example, such a machine is supposed to be a dishwasher.

The dispenser 1 has a main body 2, which can be housed at least partially in an opening provided in the counter-door of the machine door, the latter being either a tilting or sliding door; more in general, the body 2 can be fixed to any vertical surface delimiting a washing tub of the washing machine.

Figure 2:
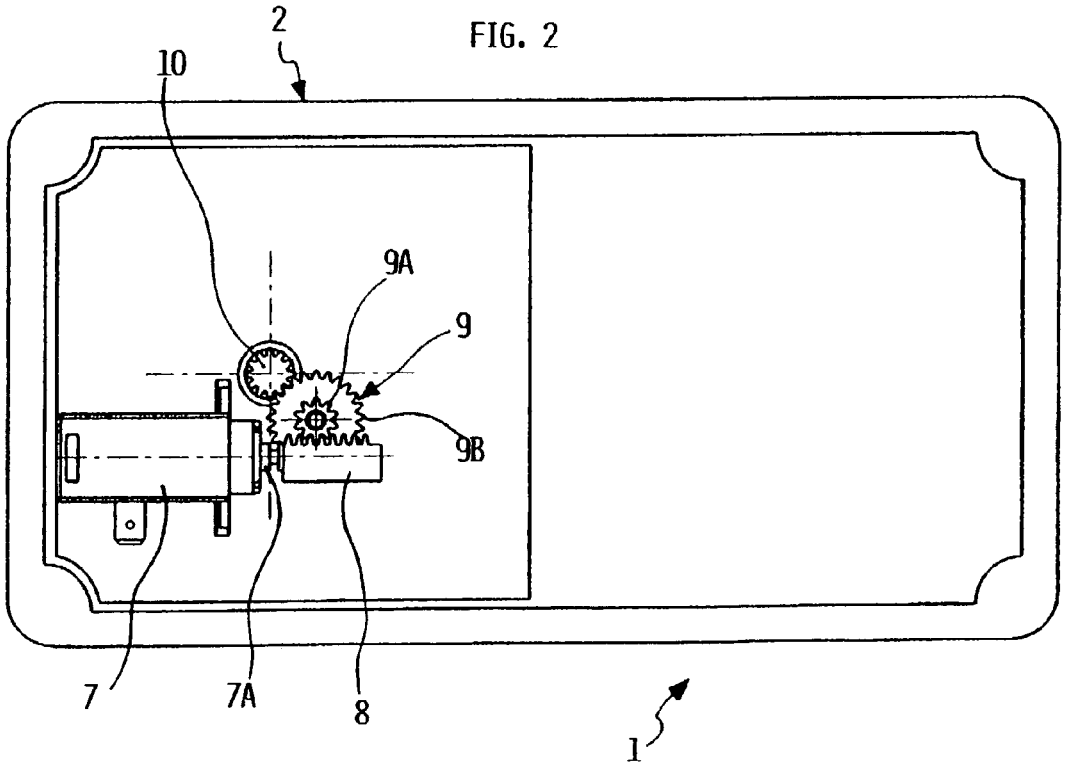
FIG. 2 shows a front view of the rear part of a dispenser of washing agents, according to the present invention.

As in the prior art, the body 2 of the dispenser 1 is realized by welding a front piece to a rear piece, both made from thermoplastic material, indicated in FIG. 2 with 2A and 2B, respectively.

Reference 3 indicates as a whole a tilting container, being provided for receiving a determined dose of detergent which is required to perform a wash cycle, which is assumed here to be a powder detergent; reference 3A indicates gripping means defined on the front surface of the container 3, for allowing an easy tilting or opening of the latter, as further described; the container 3 can be easily moulded in one piece in thermoplastic material.

Reference 4 indicates a seat defined in the body 2 for housing the container 3; in general, the seat 4 has a bigger size than the container 3, so as to leave a portion of the former—not occupied by the latter—facing directly the inside of the machine washing tub. In the specific example, the seat 4 has a shape in plan substantially elongated downwards over the overall dimensions of the container 3, so that the lower portion of it forms an outlet path for the detergent, as further described.

Within body 2 a tank is defined, for containing a certain quantity of liquid washing agent, which here is assumed to be a rinsing aid, not visible in the figures; additionally, the dispenser 1 has suitable means for dosing and dispensing such a rinsing aid; these means for dosing and dispensing, whose realization is apart from the aims of the present invention, can be of any known type and therefore they are not represented in the figures.

Reference 5 indicates the plug of an opening in communication with the above cited tank, for filling the latter with the rinsing aid. Reference 6 indicates a discharge opening through which a dose of rinsing aid can flow down into the washing tub of the dishwasher, in a known way, whereas 6A indicates an indicator for the level of the rinsing aid contained in the relevant tank.

Referring specifically to FIG. 2, reference 7 indicates a generic actuating device, being fixed in a known way to the piece 2A of the body 2, being provided for producing an angular movement of the container 3 according to the procedures described in the following.

The actuating device 7 may consist of a thermal or thermoelectric actuator, called thermo-actuator in the following, which has a general structure as described in WO-A-98/32141, whose relevant teachings are herein incorporated by reference.

It can be mentioned here that thermo-actuators as the one indicated with 7 comprise an outer housing, within which a body is located, made from an electric and thermal conducting material (e.g. metal) connected to an electric heater; in this body a chamber is defined, for containing a thermally expandable material (e.g. wax) and at least partially a thrusting element, apt to displace a piston protruding from the outer housing; typically, the electric heater consists of a PTC resistor with a positive temperature coefficient, electrically supplied by means of two terminals.

When the supply terminals are live, the electric heater supplied with current generates heat and causes the thermally expandable material to expand: such an expansion produces a linear displacement of the thrusting element outside the relevant body, causing a movement of the piston until a determined position, generally established by a mechanical stop, is reached, which can be defined as a final work position. Upon ceasing the power supply, the heater cools down and the thermo-expandable material shrinks, so causing the piston and pusher to return to their initial rest position, eventually with the aid of an elastic recall element, such as a spring. Thermo-actuators as above are mono-stable devices, i.e. besides their normal rest position they ensure only one work stroke and one final work position. Such actuators offer important advantages in view of the considerable working strength or power they are able to develop related to their small size, the low costs, the low consumption and the noiseless operation.

Back to FIG. 2, reference 8 indicates a linear toothed element or rack element engaged to a first toothing 9A of a wheel or pinion 9; the wheel 9 has a second toothing 9B being engaged on the toothing defined at the end of a shaft 10, which runs across the body 2 of the device 1 as further described. The piston 7A of the thermo-actuator 7 is made integral to the rack element 8, so that the linear movement of the former also causes a linear movement of the latter. Therefore, as it can be realized from the arrangement shown in FIG. 2, the linear movement produced by the piston 7A can be translated into a rotary movement of the shaft 10, through the rack element 8 and toothed wheel 9.

Figure 4:
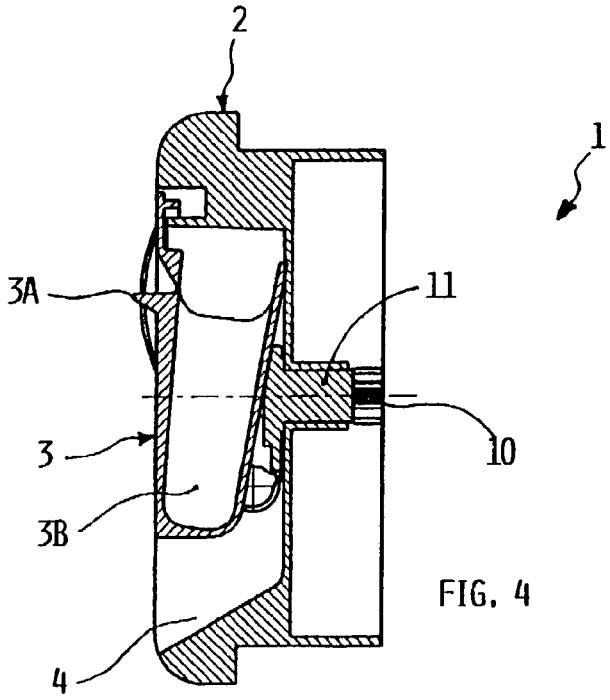
FIG. 4 shows a section, along the axis A—A of FIG. 3, of the dispenser of washing agents according to the present invention.
Figures 9, 10:
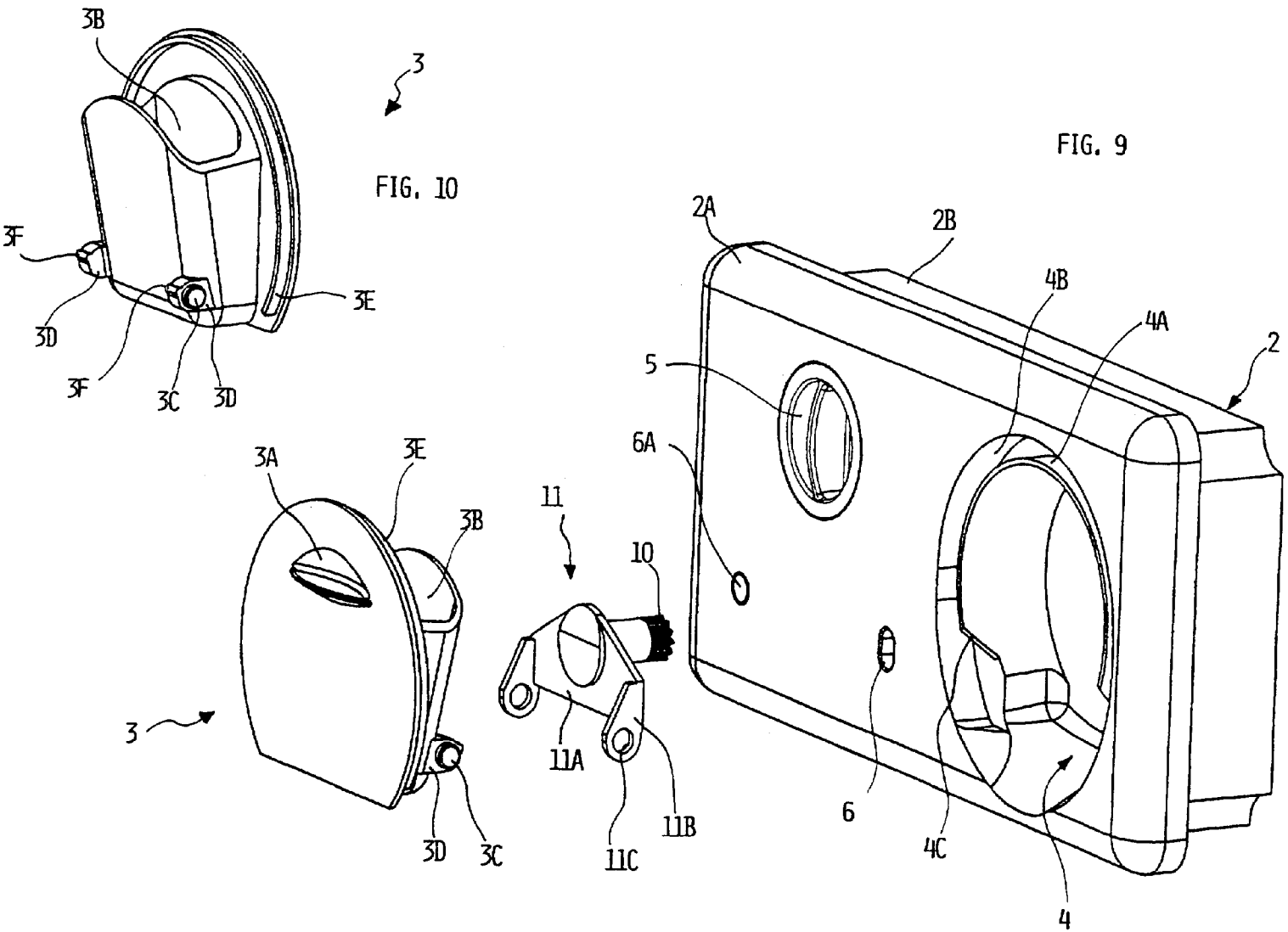
FIG. 9 shows an exploded view of some components of the dispenser of washing agents according to the present invention.
FIG. 10 shows a component of the dispenser of washing agents according to the present invention, with a different angle shot from the one visible in FIG. 9.

FIG. 4 shows how the container 3 has an inner space 3B being open upwards, apt for containing the quantity of detergent being necessary for performing a washing cycle; from this figure, as well as from FIG. 9, it can also be noticed how the shaft 10 is integrated to a fork element, indicated as a whole with 11, for supporting the container 3 and being located in the seat 4.

The fork element 11, clearly visible in FIG. 9, consists of a central plate 11A, at the two side ends of which flanges 11B are defined, each one having a respective through hole 11C; the holes 11C receive pins 3C, also shown in FIG. 10, defined on relief 3D departing from the rear surface of the container 3; the fork element 11 can be advantageously moulded in one piece of thermoplastic material, or over-moulded or co-moulded with the shaft 10, should the latter be made from metal material. Therefore, as it can be realized, by virtue of the coupling between the holes 11C and the pins 3C, the container 3 is mounted tiltable with respect to the fork element 11; thus, the container 3 can be partially tilted outside the seat 4, for filling the space 3B with the detergent; such a situation is just illustrated in FIGS. 5 and 6.

Figure 7:
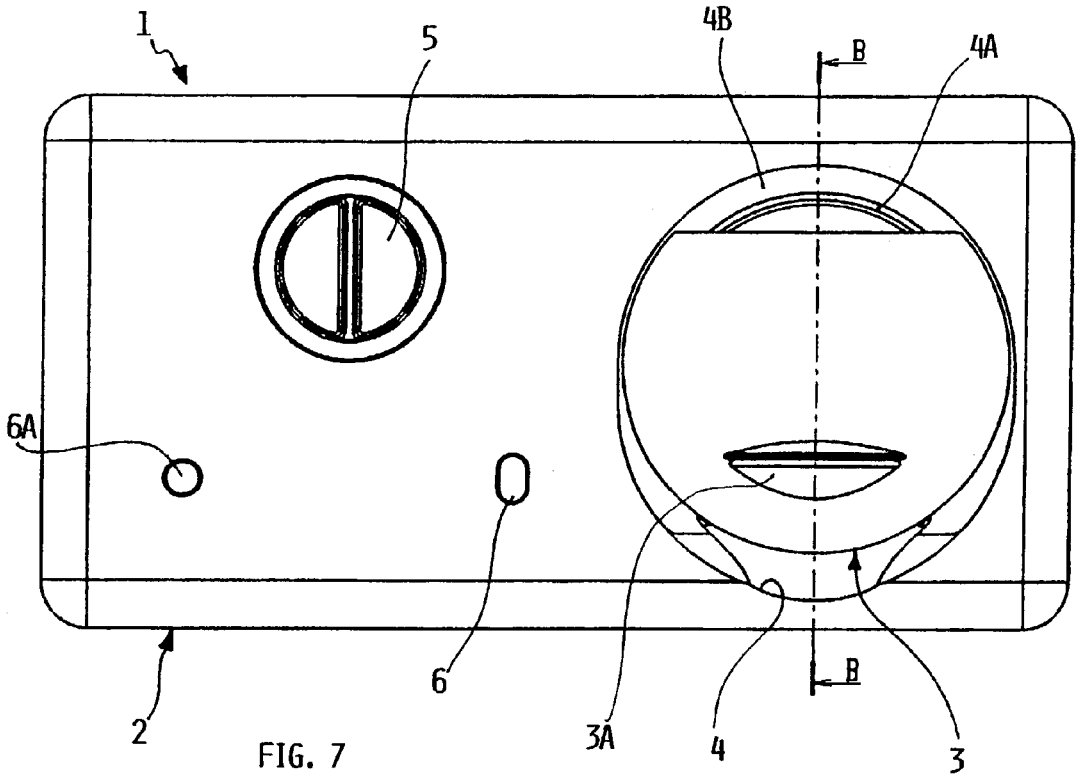
FIG. 7 shows a front view of the dispenser of washing agents according to the present invention, in a third operating condition.
Figure 8:
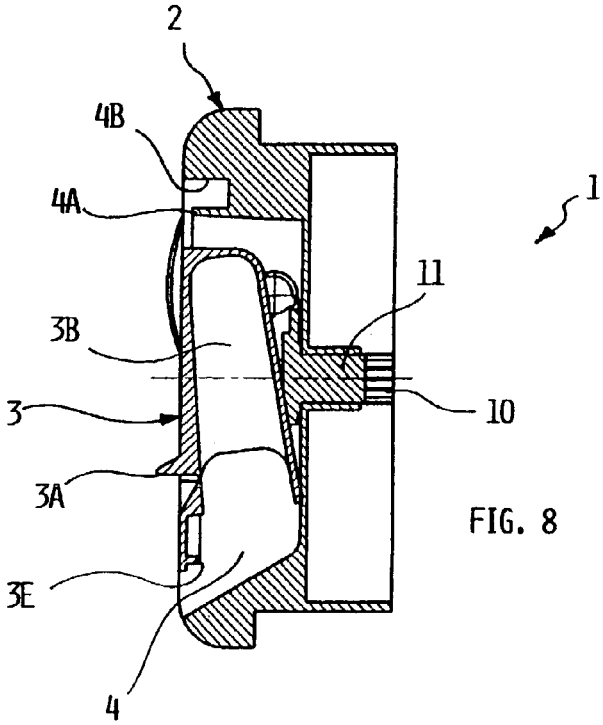
FIG. 8 shows a section, along the axis B—B of FIG. 7, of the dispenser of washing agents according to the present invention.

Moreover, as it can be imagined, since the fork element 11 is integral to the shaft 10, the rotation of the latter produced by the thermo-actuator 7 is also capable of rotating the container 3 by about 180°; thus, as said above, the opening of the space 3B can be brought in correspondence with the lower area of the seat 4, facing directly the inside of the washing tub, in order to release the detergent dose; this situation is also illustrated in FIGS. 7 and 8.

As it can be noticed from the annexed figures, the surface of the lower zone of the seat 4 is substantially inclined, with the purpose of facilitating a down fall of the detergent into the machine washing tub and the washing of this seat through the water splashes, after the container 3 has been upturned by the thermo-actuator 7, as described above.

From FIGS. 5 and 6 it can also be noticed how an intermediate wall is defined within the seat 4, extending substantially like a circular sector or circumference arch, indicated with 4A, which delimits an inner space receiving the rear portion of the container 3, i.e. the one wherein the space 3B is defined; consequently, a gap or interstice 4B is delimited between this wall 4A and the seat 4.

This interstice 4B is apt to receive a projection or wall 3E, departing from the rear surface of the front side of the container 3, when the container 3 is inserted in its relevant seat 4 (FIGS. 3 and 4); as it can be noticed, in particular from FIG. 10, the cited wall 3E extends substantially like a circular sector or circumference arch, like the wall 4A, so as to enter the interstice 4B.

As it will be described in the following, the aim of the walls 3E and 4A, as well as of the interstice 4B is to realize a labyrinth sealing arrangement, having the purpose of preventing a contact between the detergent contained in the recess 3B and the water circulating inside the machine washing tub, prior to the dispensing phase.

From FIG. 9 it can also be noticed how at least one end of the wall 4A has an inclined length or plane, indicated with 4C, whose functions will be explained in the following with reference to the operation of the dispenser 1 according to the present invention.

Figure 12:
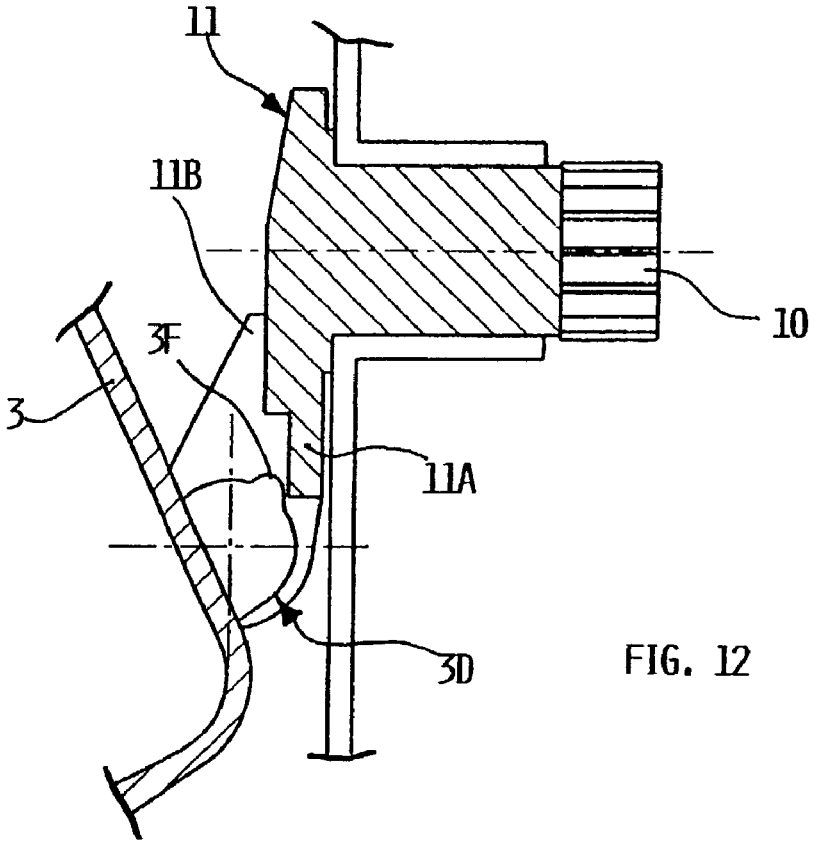
FIGS. 11 and 12 show a detail of the dispenser of washing agents according to the present invention, in two different working positions.
Figure 11:
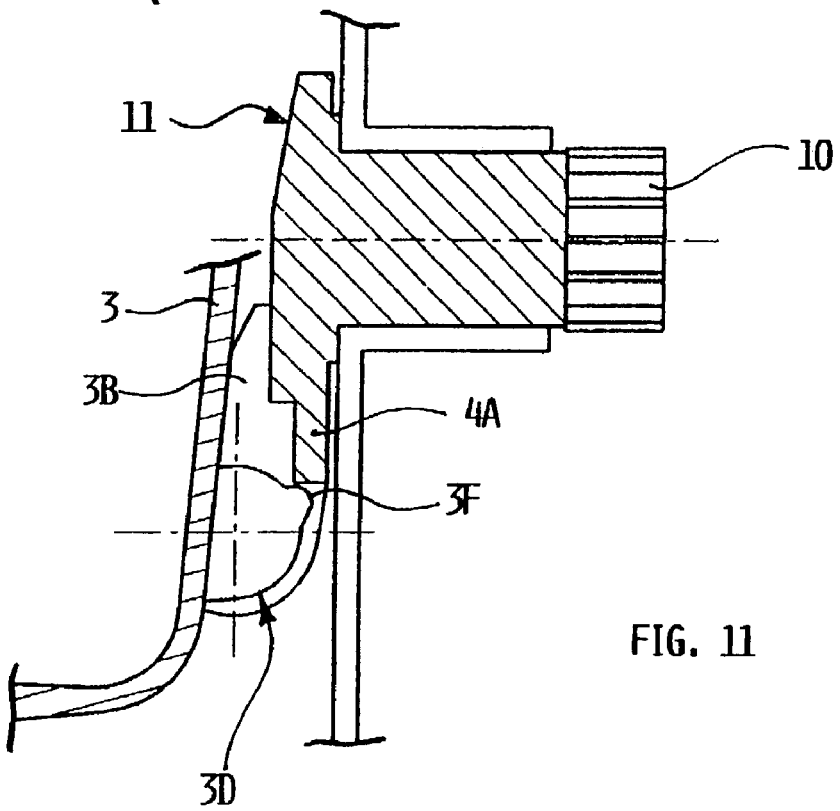

FIGS. 11 and 12 illustrate a detail of the coupling between the fork element 11 and the container 3. From these figures it can be seen in particular how, on the rear relieves 3D of the container 3, respective small teeth or bosses 3F are defined (being clearly visible also in FIG. 10), which are apt to interact with the lower edge of the central plate 11A of the fork element 11.

Figure 3:
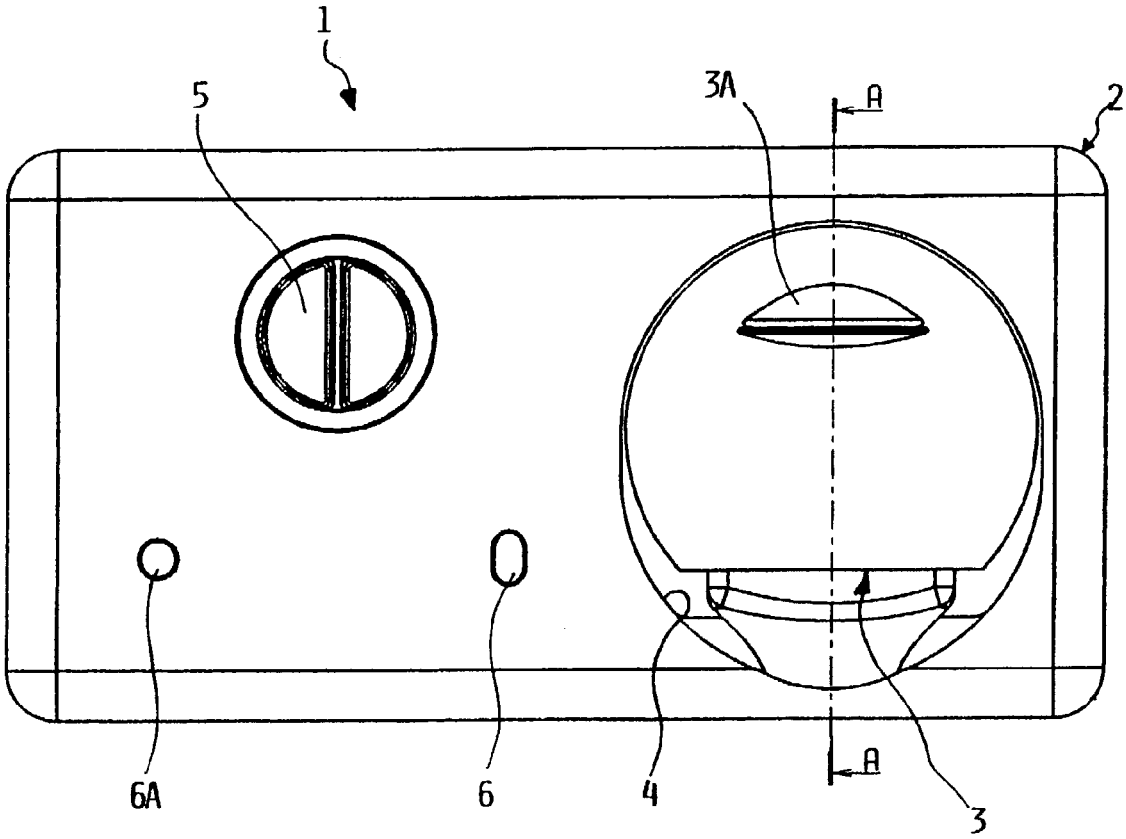
FIG. 3 shows a front view of the dispenser of washing agents according to the present invention, in a first operating condition.

In the example of FIG. 11, the container 3 is located within the seat 4, i.e. in the condition illustrated for example in FIGS. 3 and 4; as it can be noticed, in this situation, the teeth 3F result in being positioned under the lower edge of the plate 11A, so to hinder an independent angular movement of the container 3 outside its seat.

However, a soft manual pull on the container 3 through the proper gripping means 3A, makes it possible for the teeth 3F to pass over the lower edge of the plate 11A, in order to incline the container 3 towards the outside of the respective seat, i.e. in the position illustrated in FIG. 12 and FIGS. 5 and 6. It should be noticed that this movement is allowed by a relative elasticity of the coupling between the fork element 11 and the container 3, and of the material employed for manufacturing the two pieces.

After loading the necessary amount of detergent in the space 3B, the user can push the container 3 back into the respective seat 4, so realizing a new pass over movement of the teeth 3F on the lower edge of the plate 11A, so returning to the situation of FIG. 12.

As it can be seen, the teeth 3F and their interaction with the lower edge of the plate 11A of the fork element 11 have the function of realizing means, in particular of the snap-on type, for preventing an undesired tilting over or opening of the container 3.

The operation of the device 1 according to an example of the invention will be now described with reference to a possible application, i.e. of fixing on the surface of a tilting door facing inside the washing tub of a dishwashing machine.

Figure 13:
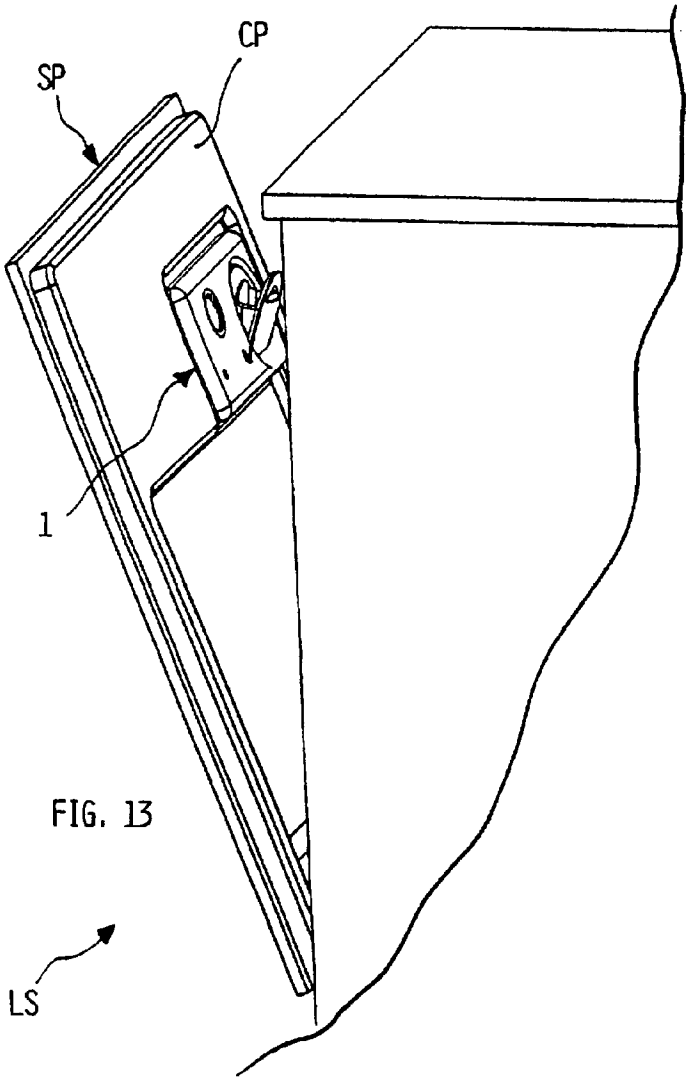

Such an application is represented in FIG. 13, where LS indicates as a whole a dishwasher fitted with a tilting loading door SP, and CP indicates the inner or counter-door, i.e. the surface of the door SP facing inside the washing tub of the machine.

It should be noticed that, according to the present invention, upon normal conditions, at the end of a washing cycle the dispenser 1 is in the position illustrated in FIGS. 3 and 4.

After loading the crockery to be washed in the washing tub and with the door half opened, as illustrated in FIG. 13, the user opens the container 3, i.e. tilts it outside the respective seat 4, as previously described with reference to FIGS. 11 and 12.

In this operating condition, being illustrated in FIGS. 5, 6 and 13, the user can therefore fill the space 3B of the container 3 with the dose of detergent being necessary for performing the washing cycle; then the container 3 can be pushed inside the seat 4, as per the same procedure previously described with reference to FIGS. 11 and 12.

Now, the user can close the door SP of the dishwasher LS and start the washing cycle, in a known way. It should be noticed that in the initial phases of the washing cycle, i.e. before the dispensing of the detergent, the inside of space 3B is adequately insulated from water splashes eventually hitting the dispenser 1.

In fact, any water eventually entering the open lower zone of the seat 4 is not able to reach the opening on top of the space 3B; on the other hand, the water investing frontally the container 3 or the part of the body 2 above the seat 4 is not able to enter the latter, by virtue of the labyrinth sealing arrangement provided by the walls 3E and 4A, and the interstice 4B.

It should be considered, in this connection, that water residues eventually overflowing the peripheral edge of the front side of the container 3 and entering the interstice 4B, will only reach the wall 3E, and eventually the most backward zone of the wall 4A. However, provided that such walls 3E and 4A have a circle arch development, these water residues will naturally flow downwards, along the same walls, to the lower zone of the seat 4; for this reason, the wall 4A may have a slightly inclined profile towards the inside.

At an appropriate time of the washing cycle, the control system of the machine electrically supplies the thermo-actuator 7; following this power supply, the piston 7A moves linearly (to the right, with reference to FIG. 2), causing an analogous linear displacement of the rack element 8; the wheel 9 is then moved angularly, so causing a consequent angular movement of the shaft 10.

The rotation of the shaft 10 determines an analogous rotation of the fork element 11, causing the container 3 to move to the operating position illustrated in FIGS. 7 and 8. It should be noticed that the stroke of the piston 7A and the ratios between the toothings of the rack element 8, the wheel 9 and the shaft 10 are advantageously provided for obtaining an angular movement of about 18020 of the container 3, up to a position like shown in FIGS. 7 and 8, following an electric supply cycle of the thermo-actuator 7.

The above upturning of the container 3 obviously causes the exit of the detergent from the space 3B to the lower open zone of the seat 4, with its consequent discharge within the washing tub.

It should be noticed that during this phase, such a discharge is favoured by likely water splashes hitting the lower open zone of the seat 4, which complete the detergent removal from that zone; it should also be noticed that in the operating condition of FIGS. 7 and 8, also the upper zone of the seat 4 faces directly the inside of the washing tub; as a result, also the water entering from that zone and flowing downwards to the seat 4 and along the walls 4A and 3F helps in removing the detergent being dispensed and in washing the lower part of the same seat 4.

After a lapse of time deemed to be sufficient for performing the above dispensing (a few tens of seconds); the power supply to the thermo-actuator 7 is cut off; in this way, the piston 7A goes backwards to its initial position illustrated in FIG. 2, through the action of an elastic recall element, such as a spiral spring, located within the body of the thermo-actuator 7 itself.

As a result, a rotary movement being opposite to the previous ones is imparted to the container 3, by means of the rack element 8, the wheel 9, the shaft 10 and the element 11, so as to brings it back to the operating condition of FIGS. 3 and 4.

The washing cycle then goes on according to known procedures.

It should be noticed that the provision of the labyrinth sealing arrangement realized through the walls 3E, 4A and the interstice 4B has to be considered as strictly necessary only for those applications where it is desired to maintain the detergent substantially dry before dispensing.

However, it is clear that such a sealing arrangement can be omitted, or the device can be modified for any applications where a partial dissolving of the detergent is desired before its actual dispensing; in this case, the walls 3E and 4A of the device may for example provide for suitable breaks, to let water portions to enter the space 3B; the same effect may be obtained through suitable passages on the front side of the container 3, above the gripping means 3A.

The device according to the present invention can also be fitted with suitable means for making the container 3 to go back automatically in the respective seat 3, for example in order to avoid that the user may accidentally leave the container in the position of FIGS. 5 and 6 after the space 3B has been filled with detergent.

According to their simplest implementation, such means may consist of an appropriate elastic recall element, such as a spring, operating for example between the fork element 11 and the container 3, in order to maintain the latter in the position of FIGS. 3 and 4; in this case, of course, the snap-on opening/closing arrangement of the container 3 described with reference to FIGS. 11 and 12 will be omitted.

Another possible solution, should the container 3 be left open, is to have it pushed inside the seat 4 by a suitable fixed striker, following the closing of the machine door; this can be obtained by appropriately positioning the dispenser 1, so that during the closing movement of the machine door the container 3 will come into contact with a portion of the crockery basket being present inside the washing tub, so as to be pushed inside the seat 4; in such an event, the basket may be fitted with a proper front extension.

As an alternative, and anyway for avoiding that a failed insertion of the container 3 back into the seat 4 may lead to a risk of damage of its actuating arrangement, the closure of the container can be ensured in an automatically way at the beginning of a detergent dispensing step, by virtue of the presence of the inclined length or plane 4A, featuring the end of the wall 4A of the seat 4.

Let assume, to this purpose, that the container 3, also following the start of a washing cycle, is still in the position of FIG. 5; during the power supply to the thermo-actuator 7, the container 3 starts its rotating movement according to the procedures described above; the rear part of the container 3 which lies under the fulcrum points realized by the pins 3C will come into contact with the inclined plane 4C visible in FIG. 9; a further rotation causes such a rear part of the container 3 to slide on the same inclined plane, forcing the latter progressively inside the seat 4, until the teeth 3F overjump the lower edge of plate 11A, as previously described with reference to FIGS. 11 and 12.

Therefore, as it can be seen, during its initial rotation, the container 3 can be automatically inserted in the respective seat 4, so avoiding any risks of damage to the device.

From the above description it is clear that the control arrangement of the dispenser described above is extremely simple, since it requires a simple and short lasting power supply to an actuator, in particular an electric actuator.

Also the manufacturing of the above dispenser is extremely simple and cost effective.

The piece 2A, wherein the seat 4 is defined, in fact, can be obtained from the moulding of a thermoplastic material with elementary operations; the same applies to the container 3 and the fork element 11, which may comprise, or be over-moulded or co-moulded, with the shaft 10; as it can be imagined, also the assembly operations of the various components of the dispenser previously described are quite simple.

As to the simplicity and reliability of assembly and operation, it should be pointed out that according to a peculiar feature of the present invention no specific rubber seals or sealing elements are strictly necessary.

According to the present invention, the insulation of the space 3B before the detergent dispensing, if required, is obtained through the labyrinth arrangement provided by the walls 3E and 4A, which are manufactured by moulding the pieces 2A and 3 in thermoplastic material, and therefore without any additional costs.

It is also pointed out that, into practice, the device 1 is conceived to have the container 3 never coming into contact with surfaces of the body 2 or other peripheral sealing elements, during its angular movement, so as to avoid any frictions; in this connection, the only friction occurring during the operation of the device 1 are due to the fork element 11, for its portion being inserted in the hole passing through the body 2A, along which sealing means can eventually be provided.

Within this frame it is also mentioned that the container 3 should not necessarily have a cylindrical form, so differing from the known long autonomy dispensing devices, which on the contrary requires a drum shaped dosing body, in order to obtain the required sealing.

The invention has been described with specific reference to the dispensing of a powder detergent; however it is clear its application is also possible in association with other types of washing agents, both in solid form (such as detergent tablets) and liquid form; it is also clear that the present invention can be used also on washing machines differing from dishwashers, such as laundry washing machines.

In the above example, the dispenser 1 according to the present invention is mounted on a tilting door, however, it is clear that, in general terms, it can be mounted also on any constantly vertical surface delimiting the washing tub of a machine; for example, the device 1 can be advantageously applied to any washing machine fitted with a door linearly sliding on appropriate guides, or on machine having only one basket for the crockery, designed as a sliding drawer, the front wall of which realizes the machine door.

Figure 14:
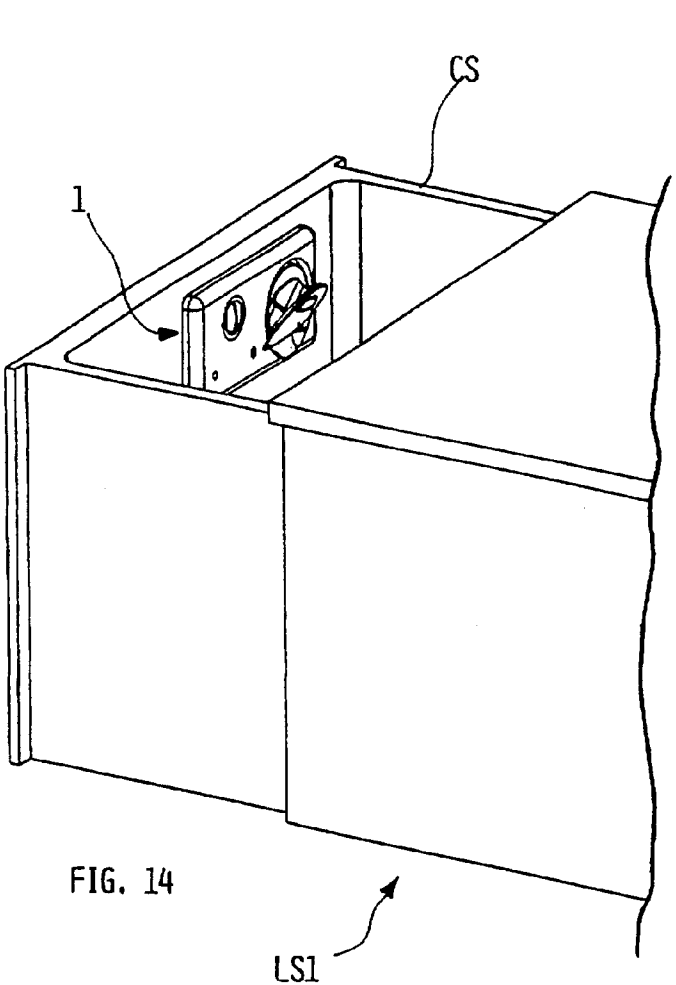
FIGS. 13 and 14 show two examples of possible practical use of the dispenser of washing agents according to the present invention.

FIG. 14 represents such a further possible application, where LS1 indicates a dishwashing machine as a whole, fitted with only one basket CS in the form of a sliding drawer; it should be noticed that also in this case the device 1 according to the present invention is mounted on the inner surface of the front side of said basket CS.

The features of the present invention are clear from the above description, as well as from the annexed claims forming an integral part of it.

From the above description and the annexed drawings also the advantages of the present invention are clear: In particular:

- the dispenser can be mounted without difficulties on tilting doors, sliding doors or constantly vertical surfaces, and the washing agent can be loaded by the user in a comfortable and easy position;
- the number of parts to be motioned for dispensing the washing agent is reduced to a minimum, and the operation frictions are minimised;
- the movements required for loading the detergent dose and obtain its subsequent dispensing are elementary;
- the actuating means for operating the device have a simple operation and control, and are reliable with time;
- the sealing means provided are simple to manufacture, since they are obtained in a single piece with the components forming the device, i.e. without additional costs;
- the components of the dosing and dispensing arrangement of the washing agent are of simple and cheap manufacturing and assembly.

It is obvious that many changes are possible for the man skilled in the art to the dispensing device of washing agents for a household washing machine, in particular a dishwasher, described above by way of example, without departing from the invention.

For example, the invention has been described with reference to the use of a thermo-actuator, but it is clear that it can also be implemented using other actuating means, such as for example a motor with a likely gear reduction unit, or an electromagnetic actuator or a pneumatic actuator, etc.

The type of coupling between the fork element 11 and the container 3 may change from the coupling described in the previous example, for example by providing pins on the flanges 11B and suitable seats fit to receive these pins on the container 3, or by a partially spherical coupling.

If desired or required, the device may by provided with specific peripheral sealing elements, for example being inserted in the gap 4B.

The dispenser 1 described by way of example may be fitted with a kinematic motion apt to produce at different times both the actuation of the container 3 and of a dispenser for a second liquid washing agent, by means of one same actuating mean 7, as per the techniques described for example in EP-A-0 602 572, or FR-A-2.593.379, or DE-A-33 04 037.

As an alternative, instead of a complex kinematic motion, the thrust of the rack element 8 (to the right, with reference to FIG. 2) might be directly exploited for actuating a rinsing aid dosing and dispensing device.

Figure 15:
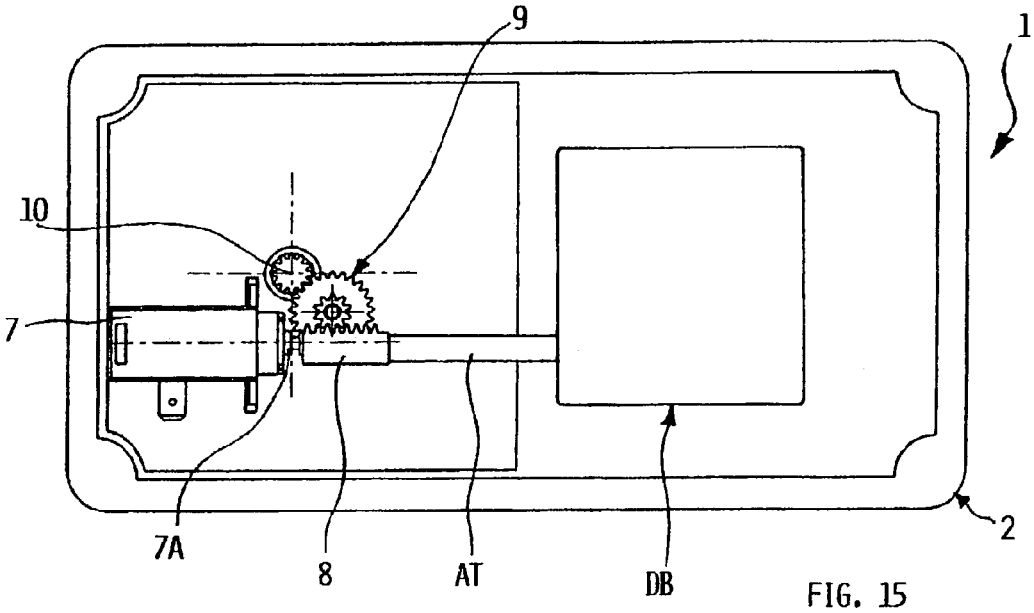
FIG. 15 shows a first possible variant embodiment of the dispenser of washing agents according to the present invention.

FIG. 15 illustrates schematically the rear part of a dispensing device manufactured according to the proposed variant embodiment of the invention, where DB indicates as a whole a dispenser of a liquid washing agent and AT a dosing and dispensing element being part of the dispenser itself, coupled to the rack element 8.

Therefore, in this case, the movement of the rack element 8 determined following a power supply to the thermo-actuator 7, as required for realizing the up-turning of the container 3, will also cause the displacement of the element AT to a first operating condition, through which the dosage is obtained of a certain amount of the liquid washing agent contained in the relevant tank.

In this case, the control system of the machine keeps the thermo-actuator 7 supplied until the dispensing of the liquid washing agent is required.

Figure 1:
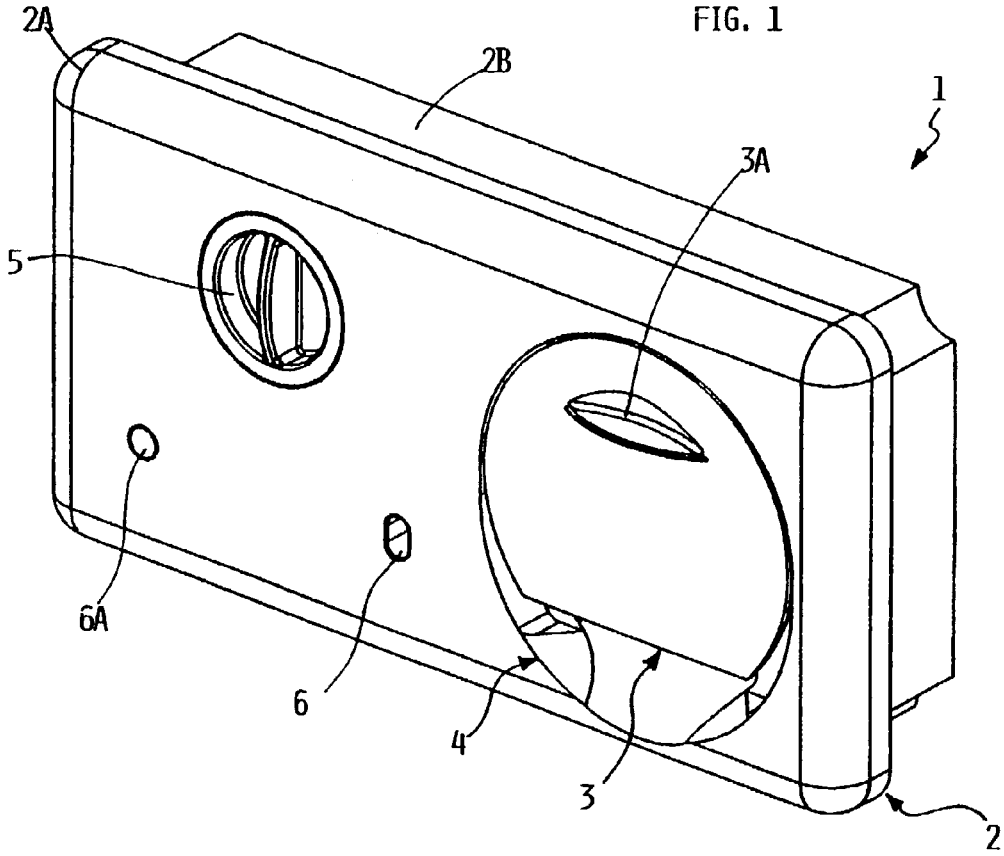
FIG. 1 shows a perspective view of the front part of a dispenser of washing agents, according to the present invention.

At that time (for example during a rinsing step), the power supply to the thermo-actuator 7 is interrupted, with a consequent return of the piston 7 and the rack element 8 to their initial positions; this also causes the element AT to return to the position represented in FIG. 15, where this movement allows the dispensing of the amount of liquid washing agent previously dosed to the washing tub, through the discharge outlet 6 of FIG. 1.

Figure 16:
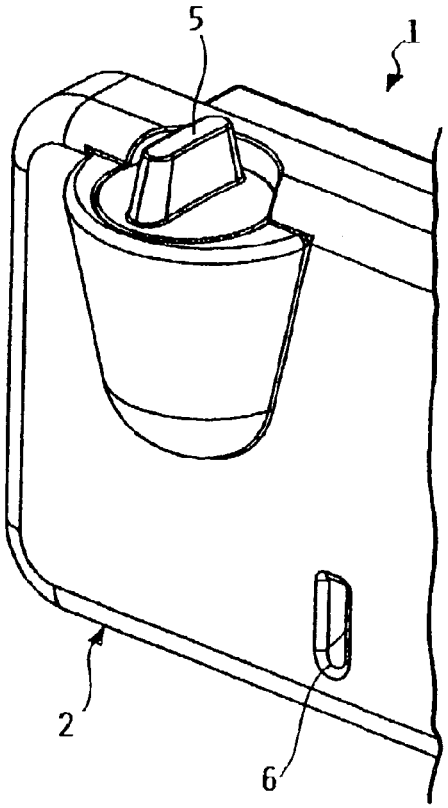
FIG. 16 shows a second possible variant embodiment of the dispenser of washing agents according to the present invention.

FIG. 16 illustrates a further possible variant embodiment of the present invention, according to which the seat of the plug 5 is designed to have the respective loading inlet of the rinsing aid facing upwards; this configuration also allows an easy loading of the liquid washing agent when the dispenser 1 is fixed to a linearly sliding door, or anyway on a constantly vertical surface; on the contrary, should the dispenser 1 be fastened to a tilting door, the above configuration allows the filling of the rinsing aid tank also with the door being half opened.

Figure 17:
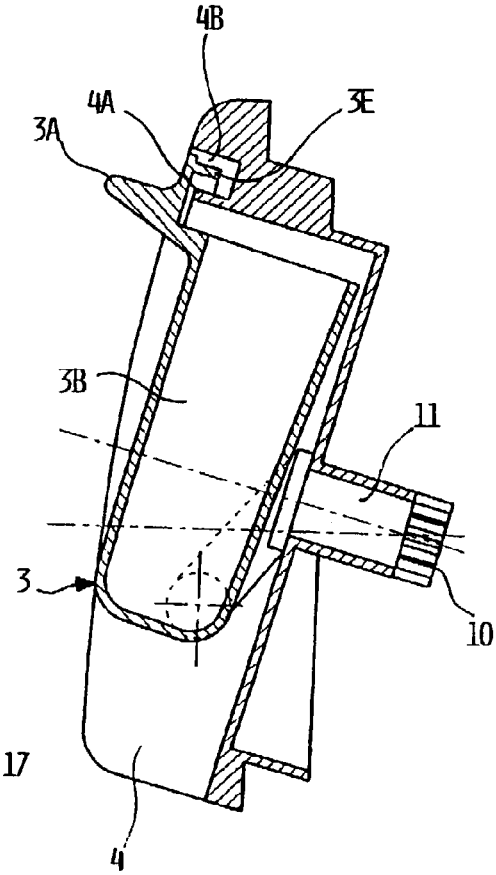
FIG. 17 shows a third possible variant embodiment of the dispenser of washing agents according to the present invention.

FIG. 17 illustrates a further possible variant embodiment of the present invention, where the body of the device 1 is realized so that, following its fixing, the rotation axis of the container 3, consisting of the fork element 11, is inclined to the horizontal and/or to the fastening wall.

As it can be noticed, in this embodiment, also the container 3 is inclined, as well as the seat 4, its wall 4A and relevant interstice 4B.

In this way, any likely water-reside overflowing the peripheral edge of the front side of the container 3 will be forcedly conveyed to the most backward zone of the wall 4A and interstice 4B, and then flow naturally downwards, as previously described.

Moreover, in this embodiment, the seat 4 results in being directly downwards opened, so that during the dispensing phase the detergent contained in the space 3B can freely fall directly into the tub, without meeting any hindrances or walls (for in the embodiments of FIGS. 3–8). It should be noticed that this implementation is particularly advantageous for employing the device according to the present invention to dispense detergents in the form of tablets or small plates.

The present invention has been described with reference to the use of actuating means apt to generate a thrust; however, it is clear that through simple modifications being well known to the man skilled in the art, the thermo-actuator 7 may be replaced by a thermo-actuator apt to exert a pull on the rack element 8, instead of a thrust.

The actuating arrangement employed may comprise an additional external spring, besides the one being available within the thermo-actuator body, for bringing the rack element 8 to its initial position, following a power cut-off to the thermo-actuator.

However, it is clear that many other changes are possible for the man skilled in the art to the dispenser of washing agents for a household washing machine, in particular a dishwasher as described above, and it is also clear that in practical actuation of the invention, the components may often differ in form and size from the ones described and be replaced with technical equivalent elements.

The invention claimed is:

1. A device for dispensing washing agents for a household washing machine, said device for dispensing having at least a space for containing an amount of washing agent being necessary for performing a washing cycle, wherein the charging of said amount of washing agent in said space is performed manually and the dispensing of the washing agent is performed at least partially by gravity, comprising a device body, and at least a dispensing body capable of performing angular or rotary movements with respect to said device body around a first axis and angular movements with respect to said device body around a second axis, wherein said second axis is substantially perpendicular to said first axis.

2. A device according to claim 1, wherein said second axis is substantially perpendicular to said first axis.

3. A device according to claim 1, further comprising a seat for said dispensing body, said dispensing body being capable of taking a first position, wherein at least a portion of said dispensing body is inserted within said seat, and a second position, wherein said portion of said dispensing body is outside said seat, for allowing said space to be filed with said amount of washing agent.

4. A device according to claim 3, wherein said seat has larger dimensions than said dispensing body.

5. A device according to claim 3, wherein a zone of said seat is directly and constantly facing the inside of a tub of the machine.

6. A device according to claim 5, wherein said dispensing body is capable of being rotated around said first axis, to bring the opening of said space substantially in correspondence with said zone, in order to allow the discharge of said amount of washing agent into said tub.

7. A device according to claim 3, comprising means for preventing an undesired passage of said dispensing body from said first to said second position, and vice-versa.

8. A device according to claim 7, wherein said means are snap-on means.

9. A device according to claim 8, wherein said means comprise one or more projections integral with said dispensing body, able for interacting with a portion of said supporting element.

10. A device according to claim 7, wherein said means comprise one or more projections integral with said dispensing body, and adapted for interacting with a portion of a supporting element.

11. A device according to claim 7, wherein said means comprise at least an elastic element.

12. A device according to claim 7, wherein said means comprise a fixed striker, for pushing said dispensing body towards said first position during the closure of a door onto which the device is mounted.

13. A device according to claim 3, wherein at least the lower zone of said seat has a substantially inclined surface.

14. A device according to claim 3, wherein a lower zone of said seat is directly open downwards or facing a tub of the machine.

15. A device according to claim 3, comprising an intermediate wall defined within said seat, extending substantially like a circular sector or circumference arch, an interstice being defined between said intermediate wall and said seat.

16. A device according to claim 15, wherein said interstice is able to receive, when said dispensing body is in said first position, a projection departing from the rear surface of the front side of said dispensing body, the development of said projection having substantially the form of a circular sector or circumference arch.

17. A device according to claim 15, wherein said means comprise at least an inclined plane or length defined at least on one end of said intermediate wall.

18. A device according to claim 3, wherein a zone of said seat is directly or constantly facing the inside of a tub of the machine.

19. A device according to claim 1, comprising a seat for said dispensing body, said dispensing body being capable of taking a first position, wherein at least a portion of said dispensing body is inserted in said seat, and a second position, wherein said dispensing body is inclined towards the outside of said seat, for allowing said recess to be filled with said amount of washing agent.

20. A device according to claim 1, wherein said dispensing body is supported by a supporting element able to rotate around said first axis.

21. A device according to claim 20, wherein said supporting element is made to rotate by an actuator.

22. A device according to claim 21, wherein said actuator is a linear actuator.

23. A device according to claim 21, wherein said actuator is a mono-stable actuator.

24. A device according to claim 21, wherein said actuator is a thermal or thermo-electric actuator.

25. A device according to claim 21, wherein said actuator is able to impart a thrust.

26. A device according to claim 21, wherein said actuator is able to exert a pull.

27. A device according to claim 21, wherein said actuator is an electromagnetic or pneumatic actuator.

28. A device according to claim 21, wherein said actuator comprises a motor with an eventual reduction gear.

29. A device according to claims 21, wherein said actuator is also provided for actuating said arrangement through kinematic or transmission means.

30. A device according to claims 29, wherein said transmission means comprise said rack element, associated to a movable component of said arrangement.

31. A device according to claim 20, wherein said supporting element is associated with a pinion actuated following the movement of a rack element.

32. A device according to claim 20, comprising mutually coupling means between said supporting element and said dispensing body, said coupling means allowing motion around said second axis of said dispensing body with respect to said supporting element.

33. A device according to claim 32, wherein said supporting element has substantially a fork shape.

34. A device according to claim 33, wherein said dispensing body is movable and tiltable with respect to said fork supporting element.

35. A device according to claim 33, wherein said fork element comprises a central plate comprising, at each of two side ends of said central plate, a respective flange, each flange having means for coupling to said dispensing body.

36. A device according to claim 33, wherein said dispensing body is movable or tiltable with respect to said fork supporting element.

37. A device according to claim 1, comprising sealing means for preventing the entry of water into said space.

38. A device according to claim 37, wherein said sealing means are labyrinth seals.

39. A device according to claim 37, wherein said sealing means are realized at least partially in a single piece with said dispensing body and the body of the device.

40. A device according to claim 37, wherein said sealing means are at least partially inclined to facilitate a water conveyance.

41. A device according to claim 37, wherein said sealing means are realized at least partially in a single piece with said dispensing body or the body of the device.

42. A device according to claim 1, wherein movement of said dispensing body around said first axis, is not impeded by surfaces of the body of the device nor peripheral sealing elements.

43. A device according to claim 1, comprising means for causing an automatic movement of said dispensing body around said second axis.

44. A device according to claim 43, wherein said means are operative for realizing said automatic movement during the movement of said dispensing body around said first axis.

45. A device according to claim 1, wherein said first axis is inclined to the horizontal.

46. A device according to claim 1, wherein said space is substantially inclined towards a tub of the machine.

47. A device according to claim 1, wherein said space is able to contain at least a detergent tablet.

48. A device according to claim 1, wherein said dispensing body comprises manual gripping means being defined on its front surface.

49. A device according to claim 1, comprising an actuating kinematic motion device, having at least a straight toothed or rack element.

50. A device according to claim 49, wherein said actuating kinematic motion device comprises a pinion.

51. A device according to claim 1, wherein said actuator has a piston or actuating element made integral with said rack element.

52. A device according to claim 1, comprising an arrangement for dispensing at least a dose of a second washing agent.

53. A device for dispensing washing agents for a household washing machine, said dispenser having at least a space for containing an amount of washing agent necessary for performing a washing cycle, wherein the charging of said amount of washing agent in said space is performed manually and the dispensing of the washing agent is performed at least partially by gravity, comprising a device body and at least a dispensing body capable of performing angular movements with respect to said device body around at least two substantially perpendicular axes.

* * * * *